US007259525B2

(12) United States Patent
Yang

(10) Patent No.: US 7,259,525 B2
(45) Date of Patent: Aug. 21, 2007

(54) HIGH EFFICIENCY SWITCHING LED DRIVER

(75) Inventor: Ta-Yung Yang, Milpitas, CA (US)

(73) Assignee: System General Corporation, Taipei Hsien (TW)

( * ) Notice: Subject to any disclaimer, the term of this patent is extended or adjusted under 35 U.S.C. 154(b) by 0 days.

(21) Appl. No.: 11/265,290

(22) Filed: Nov. 3, 2005

(65) Prior Publication Data

US 2007/0097044 A1 May 3, 2007

(51) Int. Cl.
*G05F 1/00* (2006.01)

(52) U.S. Cl. ..... 315/291; 315/308; 315/224; 315/169.3; 363/21.01; 363/21.09; 363/21.13; 345/82; 345/204

(58) Field of Classification Search ..... 315/169.1, 315/169.3, 276, 291, 307, 308, 224; 363/13, 363/21.01, 21.05, 21.09, 21.13, 21.15, 21.17, 363/21.18; 345/82, 204, 212, 213
See application file for complete search history.

(56) References Cited

U.S. PATENT DOCUMENTS 5,642,130 A * 6/1997 Browne ..... 345/111
6,320,330 B1 * 11/2001 Haavisto et al. ..... 315/291
6,721,192 B1 * 4/2004 Yang et al. ..... 363/21.18
6,748,180 B2 * 6/2004 Feng ..... 398/182
6,798,152 B2 * 9/2004 Rooke et al. ..... 315/209 R
6,836,415 B1 * 12/2004 Yang et al. ..... 363/21.01
7,116,294 B2 * 10/2006 Stopa ..... 345/82
2005/0151708 A1 * 7/2005 Farmer et al. ..... 345/82
2006/0170373 A1 * 8/2006 Yang ..... 315/209 R
2006/0214603 A1 * 9/2006 Oh et al. ..... 315/246
2006/0220570 A1 * 10/2006 Evans et al. ..... 315/86

OTHER PUBLICATIONS

U.S. Appl. No. 11/265,284 by Yang, filed Nov. 3, 2005.*
U.S. Appl. No. 11/268,536 by Yang, filed Nov. 8, 2005.*

* cited by examiner

*Primary Examiner*—Haissa Philogene
(74) *Attorney, Agent, or Firm*—Rosenberg, Klein & Lee

(57) ABSTRACT

The present invention provides a LED driver for control the brightness of the LED. An inductor and a switch are connected in serial with the LED for control the current of the LED. A control circuit is developed to generate a control signal for switching the switch in response the LED current. A diode is parallel coupled to the inductor for freewheeling the energy of the inductor through the LED.

16 Claims, 5 Drawing Sheets

HIGH EFFICIENCY SWITCHING LED DRIVER

BACKGROUND OF THE INVENTION

1. Field of the Invention

The present invention relates to a LED (light emission diode) driver, and more particularly to a control circuit for controlling the LED.

2. Description of Related Art

The LED driver is utilized to control the brightness of LED in accordance with its characteristic. The control of the LED is to control the current that flow through the LED. A higher current will increase intensity of the brightness, but decrease the life of the LED. FIG. 1 shows a traditional approach of the LED driver. The voltage source 10 is adjusted to provide a current $I_{LED}$ to LEDs 20~25 through a resistor 15. The current $I_{LED}$ can be shown as equation (1), $$I_{LED} = \frac{V - V_{F20} - V_{F21} - \ldots - V_{F25}}{R_{15}} \quad (1)$$

wherein the $V_{F20}$~$V_{F25}$ are the voltage drop of the LEDs 20~25 respectively. The drawback of the LED driver shown in FIG. 1 is the variation of the current $I_{LED}$. The current $I_{LED}$ is changed in response to the change of the voltage drop of $V_{F20}$~$V_{F25}$, in which the voltage drop of $V_{F20}$~$V_{F25}$ will be change due to the variation of the production and operating temperature. The second drawback of the LED driver shown in FIG. 1 is the power consumption of the resistor 15. FIG. 2 shows another traditional approaches of the LED driver. A current source 35 is connected in series with the LEDs 20~25 for providing a constant current flow through the LEDs 20~25. However, the disadvantage of this circuit is the power loss of the current source 35, particularly as the voltage source 30 is high and the LED voltage drop of $V_{F20}$~$V_{F25}$ are low. The objective of the present invention is to provide a LED driver for reducing the power consumption and achieving higher reliability. The second objective of the present invention is to develop a high efficiency method for controlling the brightness of the LED.

SUMMARY OF THE INVENTION

The present invention provides a switching LED driver to control the brightness of a LED. The LED driver comprises an energy-transferred element such as a transformer or an inductor. An inductor is coupled in series with the LED. A switch is connected in serial with the LED and the inductor for controlling a LED current. A control circuit generates a control signal to control the on/off of the switch in response the LED current. A diode is coupled in parallel to the LED and the inductor for discharging the energy of the inductor through the LED.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention. In the drawings, FIG. 1 shows a traditional LED driver;

DESCRIPTION OF THE PREFERRED EMBODIMENT

Figure 1:
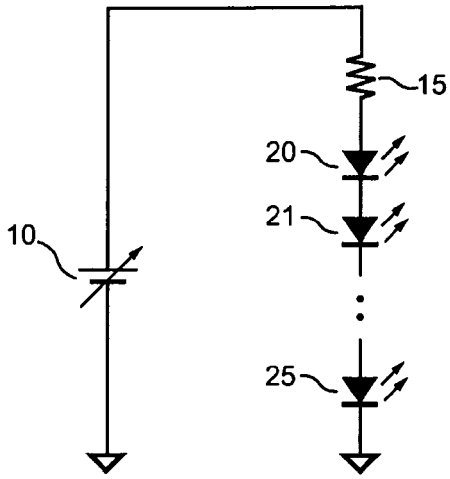
FIG. 1 (Prior Art)
Figure 2:
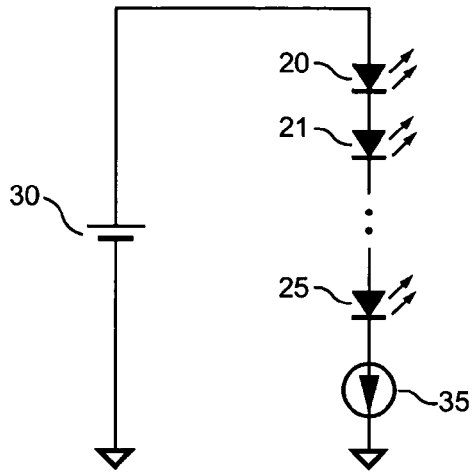
FIG. 2 (Prior Art)
FIG. 2 shows another traditional LED driver.
Figure 3:
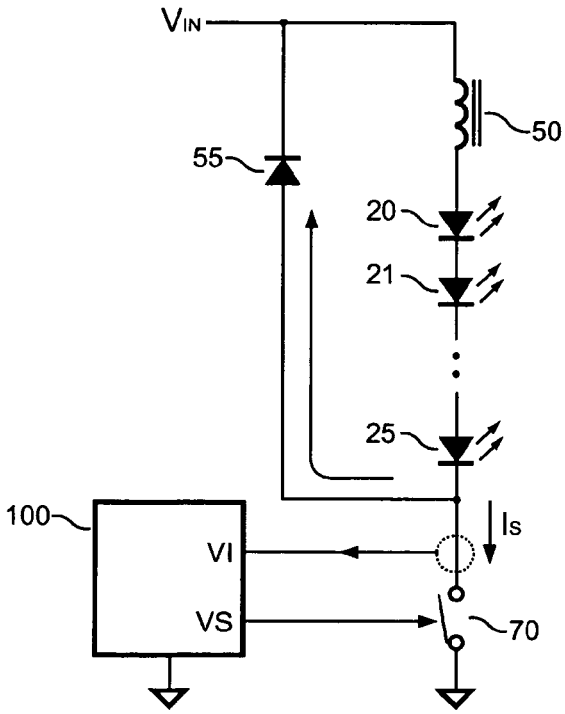
FIG. 3 shows a switching LED driver in accordance with present invention.
Figure 4A:
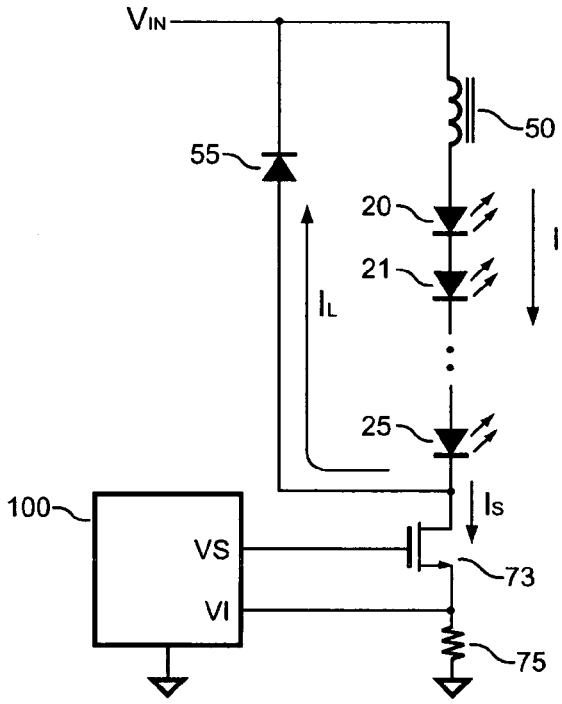
FIG. 4A shows a preferred embodiment of the switching LED driver in accordance with present invention.
Figure 4B:
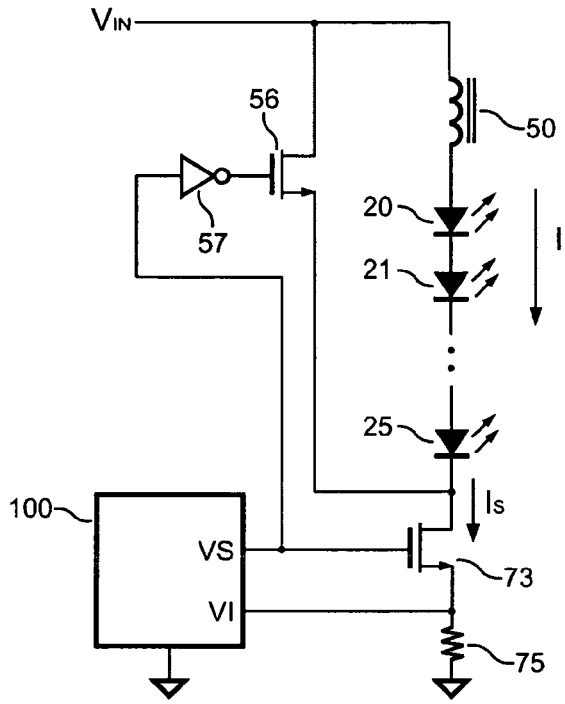
FIG. 4B shows another preferred embodiment of the switching LED driver in accordance with present invention.

FIG. 3 shows a switching LED driver in accordance with present invention, in which an inductor 50 is coupled in series with the LEDs 20~25. A switch 70 is connected in series with the LEDs 20~25. and the inductor 50 for controlling the LED current. The LED current is further converted to a $V_I$ signal to couple to a control circuit 100. The control circuit 100 generates a control signal $V_s$ to control the on/off of the switch 70 in response the LED current. A diode 55 is coupled in parallel to the LEDs 20~25 and the inductor 50 for discharging the energy of the inductor 50 through the LEDs 20~25. FIG. 4A shows a preferred embodiment of the switching LED driver, in which a MOSFET 73 is operated as the switch 70. A resistor 75 is applied to sense the LED current and generate the $V_I$ signal. Therefore the LED current is correlated to the $V_I$ signal. FIG. 4B shows another preferred embodiment of the switching LED driver. A MOSFET 56 is used to replace the diode 55, which saves the power loss caused by the forward voltage of the diode 55. Through an inverter 57, the control signal $V_s$ is coupled to drive the MOSFET 56.

Figure 5:
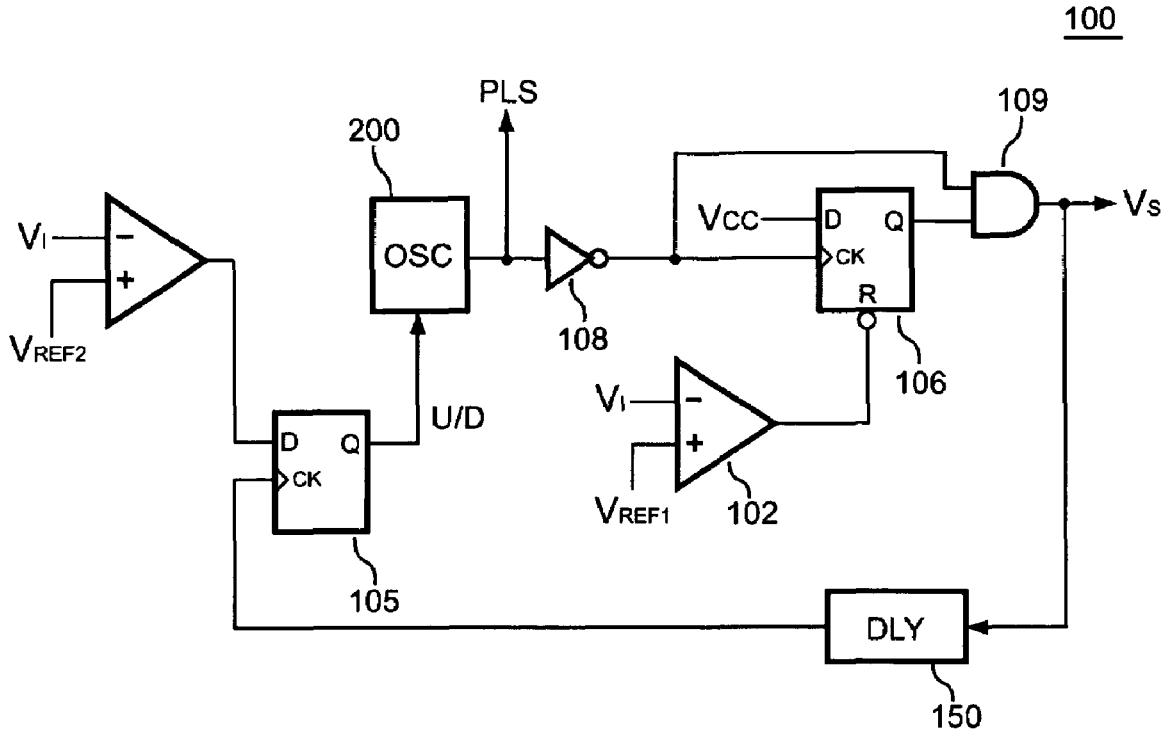
FIG. 5 shows a control circuit of the switching LED driver in accordance with present invention.
Figure 10:
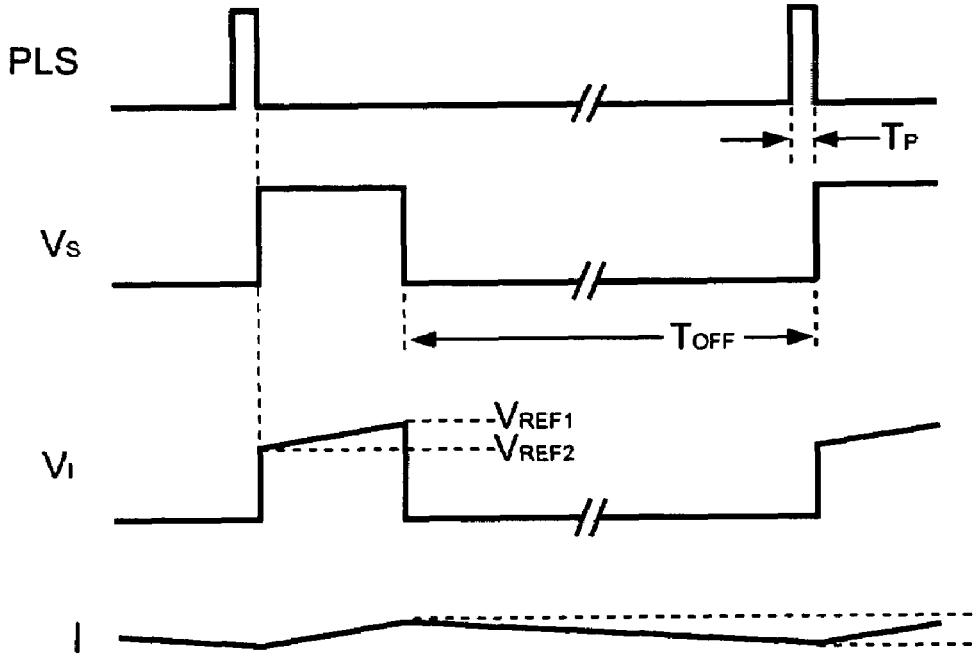
FIG. 10 shows switching waveform of the switching LED driver in accordance with present invention.

FIG. 5 shows a circuit schematic of the control circuit 100. A first threshold $V_{REF1}$ is coupled to turn off the control signal $V_s$ once the $V_I$ signal is higher than the first threshold $V_{REF1}$. A second threshold $V_{REF2}$ is coupled to turn on the control signal $V_s$ once the $V_I$ signal is lower than the second threshold $V_{REF2}$. The LED current is thus controlled in between the first threshold V REF and the second threshold $V_{RE2}$. A first control circuit including an AND gate 109, an inverter 108, a flip-flop 106 and a comparator 102 generate the control signal $V_s$ in response to a pulse signal PLS and the first threshold $V_{REF1}$. The control signal $V_s$ is generated at the output of the AND gate 109. The inputs of the AND gate 109 are connected to the output of inverter 108 and the output of the flip-flop 106. Therefore the control signal $V_s$ is off as long as the pulse signal PLS is on. Through the inverter 108, the flip-flop 106 is clocked on by the pulse signal PLS. The comparator 102 is equipped to reset the flip-flop 106. The $V_I$ signal and the first threshold $V_{REF1}$ are connected to the inputs of the comparator 102. Therefore the flip-flop 106 is reset once the $V_I$ signal is higher than the first threshold $V_{REF1}$. A second control circuit including a delay circuit 150, a flip-flop 105 and a comparator 101 generate a second control signal U/D in response the second threshold $V_{REF2}$. The second control signal U/D is generated at the output of the flip-flop 105. The delay circuit 150 is used for blanking the noise interference when the control signal $V_s$ and the MOSFET 73 are turned on. The input of the delay circuit 150 is connected to the control signal $V_s$. The output of the delay circuit 150 clocks the flip-flop 105. The D input of the flip-flop 105 is connected to the output of the comparator 101. The inputs of the comparator 101 are $V_I$ signal and the second threshold $V_{REF2}$. A third control circuit 200 generates the pulse signal PLS periodically in response to the second control signal U/D. The period of the pulse signal PLS is controlled by the second control signal U/D. A logic high of the second control signal U/D results a shorter period of the pulse signal PLS. A logic low of the second control signal U/D generates a longer period of the pulse signal PLS. FIG. 10 shows the waveforms of the switching LED driver. When the MOSFET 73 is turned on, the switching current and the $V_I$ signal will be gradually raised. The switching current is given by, $$I_S = \frac{V_{IN} - V_{F20} - \ldots - V_{F25}}{L_{50}} \times T_{ON} \quad (2)$$

Figure 6:
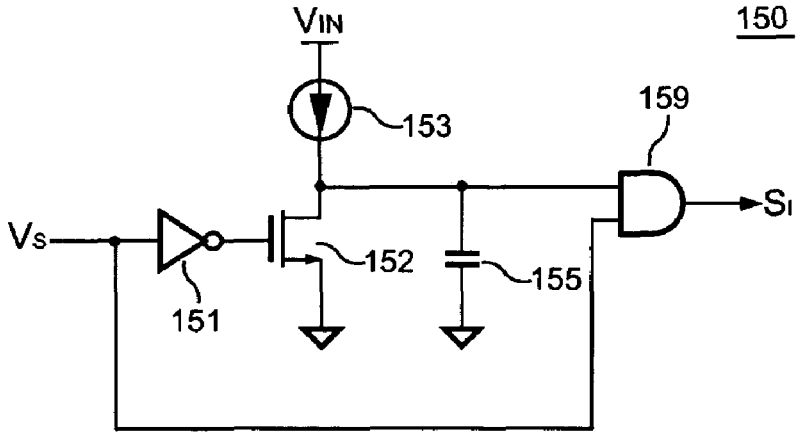
FIG. 6 shows a delay circuit of the control circuit shown in FIG. 5.

Once the $V_I$ signal is higher than the first threshold $V_{REF1}$, the control signal $V_s$ will be turned off immediately to limit the LED current. Then, the energy of the inductor 50 will be discharged through the diode 55 and the LEDs 20~25. At this moment, the LED current will be gradually decreased. After the period of the pulse signal PLS, the control signal $V_s$ will be turned on again to increase the LED current and charge the inductor 50. Once the control signal $V_s$ is turned on to switch on the MOSFET 73, the comparator 101 and flip-flop 105 are used to check the $V_I$ signal that is higher or lower than the second threshold $V_{REF2}$. If the $V_I$ signal is lower than the second threshold $V_{REF2}$, the period the pulse signal PLS will be decreased to increase the LED current. If the $V_I$ signal is higher than the second threshold $V_{REF2}$, the period the pulse signal PLS will be increased to reduce the LED current. After a period of time, the LED current will be adjusted within the range of the first threshold $V_{REF1}$ and the second threshold $V_{REF2}$. FIG. 6 shows the circuit schematic of the delay circuit 150 of the control circuit shown in FIG. 5.

Figure 7:
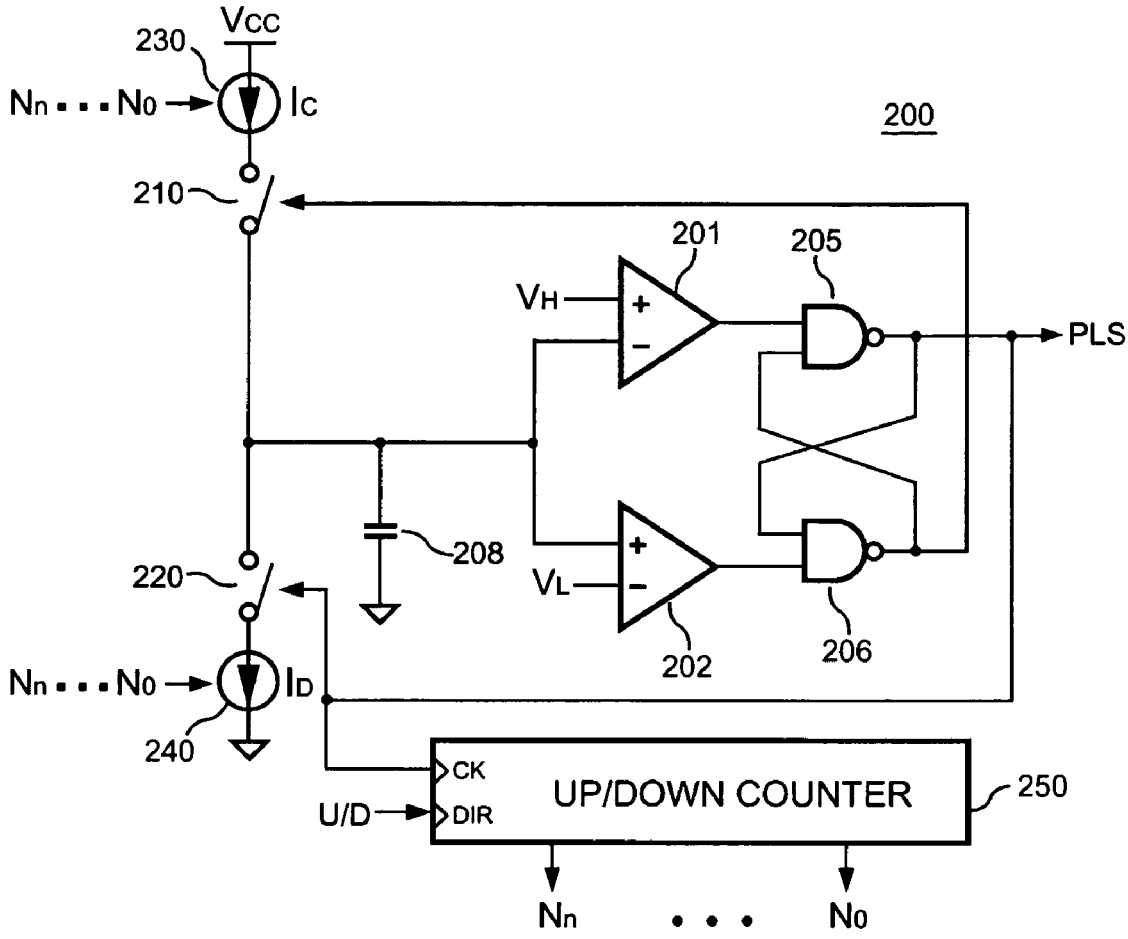
FIG. 7 shows a third control circuit of the control circuit in accordance with present invention.
Figure 8:
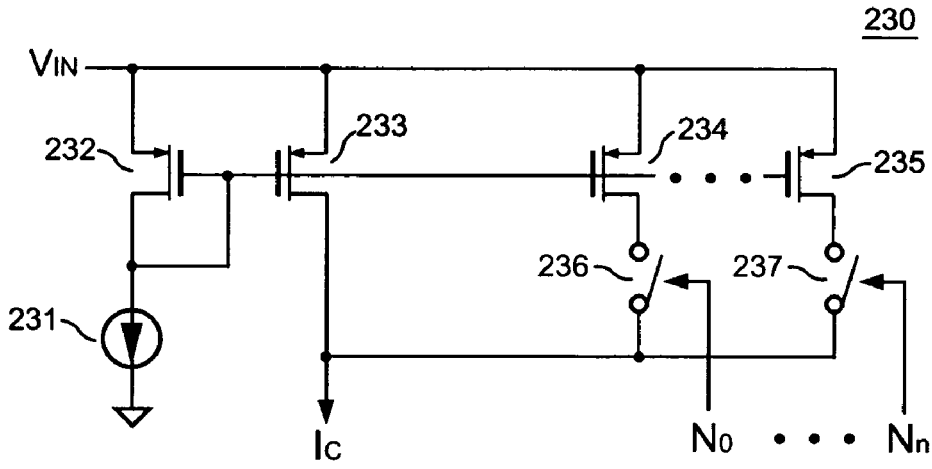
FIG. 8 shows a programmable charging current source of the oscillation circuit.
Figure 9:
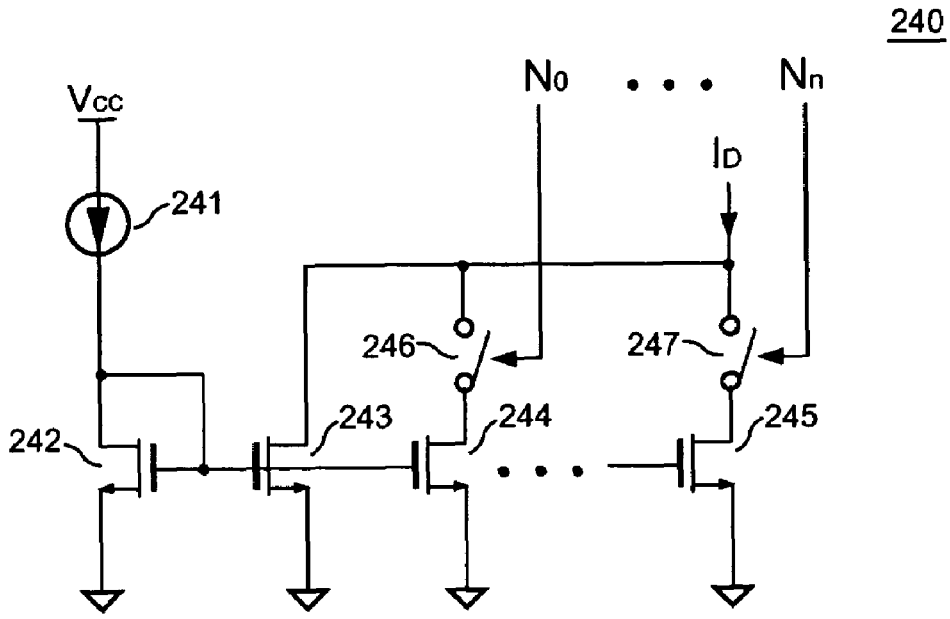
FIG. 9 shows a programmable discharging current source of the oscillation circuit.

FIG. 7 shows the third control circuit 200 of the control circuit 100 in accordance with present invention. The third control circuit 200 comprises a programmable charging current source 230 coupled to a control code Nn . . . N0 for producing a charging current IC. A programmable discharging current source 240 is coupled to a control code Nn . . . $N_0$ for producing a discharging current ID. An oscillation circuit including comparators 201, 202, NAND gates 205, 206 and the capacitor 208 generate the pulse signal PLS in response to the charging current IC and the discharging current ID. An up/down counter 250 generates the control code Nn . . . N0 in accordance with the second control signal U/D and the pulse signal PLS. When the second control signal U/D is logic high, the up/down counter will up count in response the pulse signal PLS. When the second control signal U/D is logic low, the up/down counter will be down count. The up count of the up/down counter will increase the charging current IC and then shorter the period of the pulse signal PLS. FIG. 8 and FIG. 9 show the programmable charging current source 230 and the programmable discharging current source 240 respectively. The control code Nn . . . N0 is applied to control the discharging current $I_D$, and further control the pulse width of the pulse signal PLS. Since the pulse signal PLS will turn off the control signal $V_s$ through the AND gate 109 shown in FIG. 5, the pulse width of the pulse signal can be used to control the LED current. The control code Nn . . . N0 is therefore can be utilized to control the off time of the control signal $V_s$ and the brightness of the LED.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A LED driver, comprising:

an inductor, connected in series with a LED;

a switch, connected in series with the LED and the inductor for controlling a LED current;

a control circuit, generating a control signal to control the on/off of the switch in response to the LED current, the control circuit including:

a first threshold, coupled to turn off the control signal once the LED current is higher than the first threshold:

a second threshold, coupled to turn on the control signal once the LED current is lower than the second threshold; and a diode, coupled in parallel to the LED and the inductor for discharging the energy of the inductor through the LED.

2. The LED driver as claimed in claim 1, wherein the inductor is a transformer.

3. The LED driver as claimed in claim 1, wherein the control circuit further comprises:

a first control circuit, generating the control signal in response to a pulse signal, the LED current and the first threshold;

a second control circuit, generating a second control signal in response to the second threshold, the LED current and the control signal; and a third control circuit generating the pulse signal periodically in response to the second control signal.

4. The LED driver as claimed in claim 3, wherein the third control circuit comprises:

a charging current source coupled to a control code for producing a charging current;

a discharging current source, coupled to the control code for producing a discharging current;

an oscillation circuit, generating the pulse signal in response to the charging current and the discharging current; and an up/down counter, generating the control code in accordance with the second control signal and the pulse signal;

wherein the control code is utilized to control the off time of the control signal and the brightness of the LED.

5. A LED control circuit, comprising:

an energy-transfer element, coupled in series with a LED;

a switch, coupled in series with the LED and the energy-transfer element for controlling a LED current; and a control circuit, generating a control signal to control the switch in response the LED current, the control circuit including:

a first threshold, coupled to turn off the control signal once the LED current is higher than the first threshold; and a second threshold, coupled to turn on the control signal once the LED current is lower than the second threshold.

6. The LED driver as claimed in claim 5, wherein the control circuit further comprises:

a first control circuit, generating the control signal in response to a pulse signal, the LED current and the first threshold;

a second control circuit, generating a second control signal in response to the second threshold, the LED current and the control signal; and a third control circuit, generating the pulse signal periodically in response to the second control signal.

7. The LED control circuit as claimed in claim 5 further comprising a diode coupled in parallel to the LED and the energy-transfer element for discharging the energy of the energy-transferred element through the LED.

8. The LED control circuit as claimed in claim 7 further comprising a second switch coupled in parallel to the LED and the energy-transfer element for discharging the energy of the element through the LED.

9. The LED driver as claimed in claim 6, wherein the third control circuit comprises:

a charging current source, coupled to a control code for producing a charging current;

a discharging current source, coupled to the control code for producing a discharging current;

an oscillation circuit, generating the pulse signal in response to the charging current and the discharging current; and an up/down counter, generating the control code in accordance with the second control signal and the pulse signal;

wherein the control code is utilized to control the off time of the control signal and the brightness of the LED.

10. A LED control circuit, comprising:

an energy-transfer element, coupled in series with a LED;

a switch, coupled in series with the LED and the energy-transfer element for controlling a LED current;

a control circuit, generating a control signal to control the switch in response the LED current; and a second switch, coupled to the control circuit, and in parallel to the LED and the energy-transfer element for discharging the energy of the energy-transfer element through the LED in response to the control signal.

11. The LED control circuit as claimed in claim 10, wherein the control circuit comprises:

a first threshold, coupled to turn off the control signal once the LED current is higher than the first threshold; and a second threshold, coupled to turn on the control signal once the LED current is lower than the second threshold.

12. The LED driver as claimed in claim 11, wherein the control circuit further comprises:

a first control circuit, generating the control signal in response to a pulse signal, the LED current and the first threshold;

a second control circuit, generating a second control signal in response to the second threshold, the LED current and the control signal; and a third control circuit, generating the pulse signal periodically in response to the second control signal.

13. The LED driver as claimed in claim 12, wherein the third control circuit comprises:

a charging current source, coupled to a control code for producing a charging current;

a discharging current source, coupled to the control code for producing a discharging current;

an oscillation circuit, generating the pulse signal in response to the charging current and the discharging current; and an up/down counter, generating the control code in accordance with the second control signal and the pulse signal;

wherein the control code is utilized to control the off time of the control signal and the brightness of the LED.

14. A control circuit for controlling a LED driver, comprising:

a first control circuit, generating a first control signal in response to a pulse signal, a LED current and a first threshold;

a second control circuit, generating a second control signal in response to a second threshold, the LED current and the first control signal; and a third control circuit, generating the pulse signal periodically in response to the second control signal.

15. The control circuit as claimed in claim 14, wherein the third control circuit comprises:

a charging current source, coupled to a control code for producing a charging current;

a discharging current source, coupled to the control code for producing a discharging current;

an oscillation circuit, generating the pulse signal in response to the charging current and the discharging current; and an up/down counter, generating the control code in accordance with the second control signal and the pulse signal;

wherein the control code is utilized to control the off time of the first control signal and the brightness of the LED.

16. The control circuit as claimed in claim 14, wherein the LED driver comprises:

an energy-transfer element, coupled in series with a LED; and a switch, coupled in series with the LED and the energy-transfer element for controlling a LED current.

* * * * *